United States Patent [19]

Mattern

[11] 4,017,720

[45] Apr. 12, 1977

[54] FOUR QUADRANT ANALOG BY DIGITAL MULTIPLIER

[75] Inventor: John Mattern, Catonsville, Md.

[73] Assignee: Westinghouse Electric Corporation, Pittsburgh, Pa.

[22] Filed: Dec. 4, 1975

[21] Appl. No.: 637,549

[52] U.S. Cl. ..... 235/150.52; 340/347 DA

[51] Int. Cl.[2] ..... G06J 1/00

[58] Field of Search ..... 235/150.52, 150.5, 194; 340/347 DA

[56] References Cited

UNITED STATES PATENTS

| | | | |
|---|---|---|---|
| 2,966,302 | 12/1960 | Woolf et al. | 235/150.52 |
| 3,309,508 | 3/1967 | Witt | 235/150.52 |
| 3,469,080 | 9/1969 | Schmid et al. | 235/150.52 |
| 3,484,589 | 12/1969 | Jernakoff | 235/150.52 |
| 3,633,005 | 1/1972 | Leighton | 235/150.52 |
| 3,683,165 | 8/1972 | Grobert et al. | 235/150.52 X |

*Primary Examiner*—Joseph F. Ruggiero
*Attorney, Agent, or Firm*—R. G. Brodahl

[57] ABSTRACT

A four quadrant analog by digital multiplier includes an amplifier gain network in which the digital sign bit controls the polarity of the gain of an amplifier to determine the product of the digital sign and the analog value, and in which the digital magnitude bits control a multiple of resistor steps of a resistance network to determine the product of the digital magnitude and analog value as previously multiplied by the digital sign bit in the amplifier gain network.

16 Claims, 1 Drawing Figure

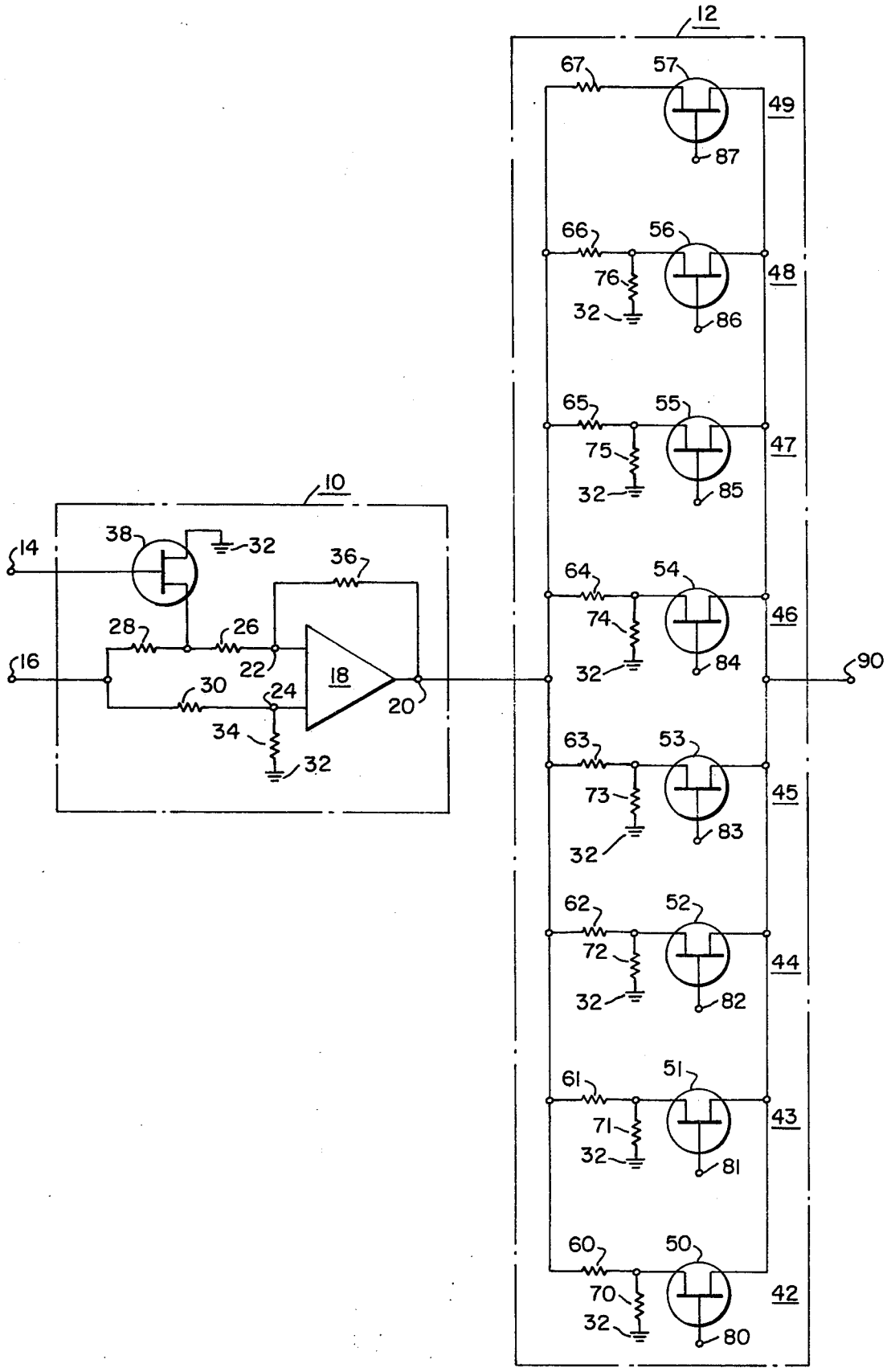
12
67
57
49
87
66
56
76
48
32
86
65
55
75
47
32
85
10
38
32
14
36
64
54
28
26
74
46
16
22
18
32
84
90
30
24
20
34
32
63
53
73
45
32
83
62
52
72
44
32
82
61
51
71
43
32
81
60
50
70
42
32
80

FOUR QUADRANT ANALOG BY DIGITAL MULTIPLIER

BACKGROUND OF THE INVENTION

1. Field of the Invention

The invention relates to analog by digital multipliers capable of operating in all four quadrants of analog and digital sign combinations.

2. Description of the Prior Art

In situations which require the multiplication of an analog value by a digital value, as, for example when real-time analog data is to be modified according to stored digital data, there is a requirement for an analog by digital multiplier. Analog by digital multipliers of the prior art have routinely performed such multiplications for a particular combination of digital and analog signs. For example, the multiplication has been performed provided that the digital and analog values are both positive. However, there are four possible combinations of analog and digital signs: both may be positive; both may be negative; the digital may be positive while the analog is negative; or the analog may be positive while the digital is negative. These four possibilities are commonly referred to as the four quadrants of analog by digital multiplication.

Analog by digital multipliers which are operable in all four quadrants have been developed in the prior art. Some prior art multiplier devices have utilized an operational amplifier for the purpose of multiplying the two values. These devices generally achieve multiplication by the control of a resistance located at one of the inputs to the operational amplifier. Another approach has been to carry a particular sign bit along with the digital information and to supply the binary data in its complement form for multiplication. Some four quadrant multipliers involve the use of two quadrant multipliers which are made to behave as four quadrant devices as by adding a constant voltage to a variable that is not permitted to change signs. In other prior art four quadrant multipliers, the sign bit of the digital value is used for switching purposes at the output of an operational amplifier.

SUMMARY OF THE INVENTION

The disclosed invention provides apparatus for multiplying an analog value by a digital value for any combination of analog and digital signs. This apparatus includes an amplifier gain network for controlling the analog value in relation to the sign of the digital value and a resistance network for controlling the magnitude of the analog value in relation to the magnitude of the digital value. The amplifier gain network is comprised of an amplifier having inverting and non-inverting inputs, first, second, third, and fourth input impedances and a feedback impedance of predetermined values, and a switch which is controlled in relation to the sign of the digital value. The resistance network includes a multiple of resistance steps connected in parallel relation and which are comprised of step impedance, switch and ground impedance combinations.

The purposes of the disclosed invention include providing an analog by digital multiplier which utilizes the sign plus magnitude binary format; providing an analog by digital multiplier with accuracy comparable to the accuracy to a digital to analog converter; and providing an analog by digital multiplier which is operable at relatively high speeds.

DESCRIPTION OF THE DRAWINGS

The FIGURE shows a symbolic representation of the preferred embodiment of the invention.

DESCRIPTION OF THE PREFERRED EMBODIMENT

As shown in the FIGURE, the disclosed analog by digital multiplier expresses the product of an analog value, represented by an analog voltage, and a digital value, represented by a digital binary word comprised of a digital sign bit and at least one digital magnitude bit. An amplifier gain network 10 controls the sign of the analog voltage in relation to the digital binary representing the sign of the digital value and a resistance network 12 controls the magnitude of the analog voltage in relation to the digital binary bits representing the magnitude of the digital value. The output of resistance network 12 is a current whose magnitude and direction represent the magnitude and sign product of the analog and digital values.

The multiplication process can be numerically expressed as:

$$I_o = [SV_i]\left[\frac{B_1}{R_1} + \frac{B_2}{2R_1} + \frac{B_3}{4R_1} + \ldots + \frac{B_n}{R_1 2^{(n-1)}}\right] \quad (1)$$

where $I_o$ is the output current representing the product of the analog and digital values;

$S$ is the sign of the digital value;

$V_i$ is the analog voltage representing the analog value;

$R_1$ is the resistance of the branch input impedance included in the branch of the resistance network associated with the most significant digital magnitude bit;

$n$ is an integer representing the significance of a particular digital magnitude bit; and $B_n$ is the binary value of the nth magnitude bit of the digital value.

Referring to the right-hand side of equation (1), unity gain amplifying network 10 determines the quantity $SV_i$; the product of the sign of the digital value S, is provided to digital sign bit input terminal 14, and the analog value $V_i$, is provided to analog input terminal 16. Amplifier gain network 10 includes an amplifier 18, which is provided with an output terminal 20, an inverting input terminal 22, and a non-inverting input terminal 24. Inverting input terminal 22 is electrically connected to analog input terminal 16 through a first input impedance 26, and a second input impedance 28. Non-inverting input terminal 24 is electrically connected to analog input terminal 16, through a third input impedance 30 and to ground contact 32 through a fourth input impedance 34. Inverting input terminal 22 is connected to output terminal 20 through feedback impedance 36. When the digital number has a positive sign, the binary value of the digital sign bit is applied to terminal 14 causing a switch which, for example, may be comprised of field effect transistor 38, to close so that the junction of first input impedance 26 and second input impedance 28 is selectively coupled to ground contact 32. When the digital number has a negative sign, the binary value of the digital sign bit causes field effect transistor 38 to open so that the junction of input impedances 26 and 28 is electrically isolated from ground contact 32.

Basic operational amplifier gain equations will be used to demonstrate that amplifier gain network 10 will provide either positive or negative gain depending upon the condition of field effect transistor 38 and the resistive magnitudes of impedances 26, 28, 30, 34 and 36. First input impedance 26 and second input impedance 28 have equal resistive magnitudes which are represented as $R_a$; Fourth input impedance 34 has a resistive magnitude which may be represented as $R_b$; third input impedance 30 has a resistive magnitude which is represented as $\alpha R_b$, and feedback impedance 36 has a resistance magnitude which is represented as $\alpha R_a$. When the field effect transistor 38 is conducting, the gain (G) is positive and may be expressed by the equation:

$$G = \frac{R_b}{R_b + \alpha R_b} \times [1 + \alpha R_a / R_a] \quad (2)$$

When field effect transistor 38 is non-conducting, the gain (G) is negative and may be expressed by the equation:

$$G = \frac{-\alpha R_a}{2R_a} + \frac{R_b}{\alpha R_b + R_b}\left[1 + \frac{\alpha R_a}{2R_a}\right] \quad (3)$$

If the output amplifier gain network 10 at output terminal 20 represents a value whose magnitude is the magnitude of the analog number and whose sign is the product of the signs of the analog and digital numbers, the gain of gain network 10 must be positive unity when the sign of the digital number is positive and negative unity when the sign of the digital number is negative. This may be expressed mathematically as:

$$G = \frac{R_b}{R_b + \alpha R_b} \times \left[1 + \frac{\alpha R_a}{R_a}\right] = 1 \quad (4)$$

and:

$$G = -\frac{\alpha R_a}{2R_a} + \frac{R_b}{\alpha R_b + R_b}\left[1 + \frac{\alpha R_a}{2R_a}\right] = -1 \quad (5)$$

Using the quadratic equation, the simultaneous solution for $\alpha$ has the result that:

$$\alpha = 1 + \sqrt{5} \quad (6)$$

Equation (6), therefore, gives the unique solution of $\alpha$ for the preferred embodiment of FIG. 1. Therefore, when the sign of the digital number is positive and the binary value provided to digital sign bit input terminal 14 causes field effect transistor 38 to close, the gain of amplifier network 10 is positive unity. In the same fashion, when the sign of the digital number is negative and the binary value provided to digital sign bit input terminal 14 causes field effect transistor 38 to open, the gain of amplifier network 10 is negative unity.

Referring again to equation (1), the output of resistance network 12 provides $$SV_i\left[\frac{B_1}{R} + \frac{B_2}{2R} + \frac{B_3}{4R} + \ldots + \frac{B_n}{R2^{(n-1)}}\right],$$

the product of the output of the gain network 10 $[SV_i]$ by the magnitude of the digital number $$\left[\frac{B_1}{R} + \frac{B_2}{2R} + \frac{B_3}{4R} + \ldots \frac{B_n}{R2^{(n-1)}}\right],$$

which is equal to $I_o$ the product of the analog and digital values. In the preferred embodiment, resistance network 12 is a modified form of a digital-to-analog converter in which the binary values of the magnitude bits of the digital number control respective switches and the output of gain amplifier 10 replaces the stable voltage reference which is usually provided. The resistance network 12 is comprised of networks 42–49 which include switches comprised of field effect transistors 50–57; branch input impedances 60–67 and branch ground impedances 70–76. The conduction of field effect transistors 50 through 57 is controlled by the binary values of the digital magnitude bits which are provided to digital magnitude terminals 80 through 87 respectively. Switches 50 through 57 are connected to input impedances 60 through 67 respectively as illustrated in the FIGURE. The resistive magnitude of impedances 60 through 67 increase progressively according to the relation:

$$R_n = 2^{n-1} \cdot R_1 \quad (7)$$

where:

$n$ is an integer representing the significance of a particular digital magnitude bit;

$R_1$ is the resistance of the branch input impedance included in the branch of the resistor network associated with the most significant digital magnitude bit;

$R_n$ is the resistance of the branch input impedance for the nth branch of resistor network 12.

In the FIGURE the resistance network 12 will accommodate a digital value whose magnitude is represented by eight digital bits. If $R_1$, the resistance of the branch impedance 67, associated with the most significant digital bit, is 200 ohms; the resistance branch impedance 66, associated with the second most significant bit, is 400 ohms. Similarly, the resistance of branch impedance 65 associated with the third most significant bit, is 800 ohms; the resistance of branch impedance 64 is associated with the fourth most significant bit is 1600 ohms; and the resistance of branch impedance 63 associated with the fifth most significant bit is 3200 ohms. The resistances of branch impedances 62, 61 and 60 would increase in a similar manner.

The junction of field effect transistors 50 through 56 with respective branch impedances 60 through 67 are connected to ground potential 32 through respective branch ground impedances 70 through 76. The resistive magnitude of ground impedances 70 through 76 decreases progressively according to the relation:

$$R_{gn} = \frac{2^{n-1} \cdot R_1}{2^{n-1} - 1} \quad (8)$$

where:

$n$ is an integer representing the significance of a particular digital magnitude bit;

$R_1$ is the resistance of the branch input impedance included in the branch of the resistor network associated with the most significant digital magnitude bit; and $R_{gn}$ is the value of the branch ground impedance of the nth resistor step. If $R_1$, the resistance of the branch impedance 67, associated with the most significant digital bit, is 200 ohms, the resistance of branch ground impedance 76, associated with the second most significant bit, is 400 ohms. Similarly, the resistance of branch impedance 75 associated with the third most significant bit is 800/3 ohms; the resistance of branch impedance 74 associated with the fourth most significant bit is 1600/7 ohms; and the resistance of branch impedance 73 associated with the fifth most significant bit is 3200/15 ohms. The resistances of branch impedances 72, 71 and 70 would decrease in a similar manner. Since the solution to equation (8) is infinity when $n$ equals one, it is unnecessary to provide a branch ground impedance to the branch 49 which is responsive to the most significant digital magnitude bit.

When field effect transistors 50–57 are non-conducting, respective branches 42–49 provide no current to the output current $I_o$. When field effect transistors 50–57 are conducting, branches 42–49 respectively contribute to the output current $I_o$ by an amount $$[SV_i]\left[\frac{1}{R_1 \cdot 2^{(n-1)}}\right].$$

When the binary value of a digital magnitude bit is zero, the field effect transistor of the network branch associated with that digital magnitude bit is made non-conductive by the signal provided to the respective digital magnitude terminal 80–87. When the binary value of a digital magnitude bit is one, the signal provided to the respective digital magnitude terminal makes the associated field effect transistor conductive. In this manner the current provided by the branches 42–49 in which field effect transistors 50–57 are conducting provide the output current $I_o$ which represents the product of the analog and digital signals.

Assuming negligible impedance in amplifier 18, when field effect transistors 50–57 are conducting, the effective resistance at each branch 42–49 of resistance network 12 is $R_1$. This is demonstrated by the following equations:

$$R_{n(eff)} = \frac{(R_n)(R_{gn})}{R_{gn} + R_n} \tag{9}$$

where:

$R_{n(eff)}$ is the effective resistance of the nth branch. Substituting equations (7) and (8).

$$R_{n(eff)} = \frac{(2^{n-1} \cdot R_1)\left(\frac{2^{n-1} \cdot R_1}{2^{n-1}-1}\right)}{\frac{2^{n-1} \cdot R_1}{2^{n-1}-1} + 2^{n-1} \cdot R_1} \tag{10}$$

-continued $$= \frac{\frac{2^{n-1} \cdot R_1}{2^{n-1}-1}}{\frac{1}{2^{n-1}-1}+1} = \frac{R_1 2^{n-1}}{1+2^{n-1}-1} = R_1 \tag{11}$$

Since the impedances of resistor network 12 provide a constant resistance to field effect transistors 50 through 57, an error caused by the finite resistance of the field effect transistors can be compensated for by matching the resistances of field effect transistors 50 through 57 and reducing the value of the branch input impedances 60 through 67 and branch ground impedances 70 through 76 by an amount substantially equal to the resistance of each transistor 50–57. Therefore, the output of resistance network 12 is a current provided to multiplier output terminal 90 which represents the product of the analog voltage provided to terminal 16 and the digital value provided to terminal 14 and terminals 80 through 86.

I claim:

1. Apparatus for the four quadrant multiplication of an analog value by a digital value having a sign plus magnitude binary format comprised of a sign bit and at least one magnitude bit, said apparatus comprising:

an amplifier gain network which provides an output substantially equivalent to the product of said analog value and the sign of said digital value; and a resistance network responsive to said amplifier network for providing an output substantially equivalent to the product of the output of said amplifier gain network and the magnitude of said digital value.

2. Apparatus for the four quadrant multiplication of an analog value by a digital value having a sign plus mangnitude format including a sign bit and at least one magnitude bit, said apparatus comprising:

an amplifier gain network which provides an output voltage whose magnitude is substantially equivalent to the magnitude of said analog value and whose polarity is substantially equivalent to the product of the signs of said analog and digital values; and a resistance network responsive to the output voltage of said amplifier network for providing an output current of a magnitude substantially equivalent to the product of the magnitudes of the analog and digital values, and having a direction substantially equivalent to the product of the signs of the analog and digital values.

3. Apparatus for the four quadrant multiplication of an analog value by a digital value having a sign plus magnitude format including a sign bit and at least one magnitude bit, said apparatus comprising:

an amplifier gain network which is responsive to said analog value and the sign of said digital value to provide an output voltage whose magnitude is substantially equivalent to the magnitude of said analog value and whose polarity is substantially equivalent to the product of the signs of said analog digital values; and a resistance network responsive to the output voltage of said amplifier network and to the magnitude of said digital value of positive and negative digital signs, to provide an output current of a magnitude substantially equivalent to the product of the magnitudes of the analog and digital values, and having a direction substantially equivalent to the product of the signs of the analog and digital values.

4. The apparatus of claim 3 in which said amplifier gain network includes:

an amplifier having an inverting input terminal, a non-inverting input terminal, and an output terminal;

a first input impedance forming a junction with said inverting input terminal of said amplifier;

a second input impedance forming a junction with said first input impedance; and a switching means for selectively connecting the junction of said first and second input impedances to ground potential to cause the gain of the amplifier to be positive or negative.

5. The apparatus of claim 4 in which the gain of said amplifier is positive if said switching means is in a closed condition and the gain of said amplifier is negative if said switching means is in an open condition.

6. The apparatus of claim 4 in which said amplifier provides a unity gain which is positive if said switching means is in a closed condition and which is negative if said switching means is in an open condition.

7. The apparatus of claim 4 in which the value of said first impedance is substantially equal to the value of said second impedance.

8. The apparatus of claim 4 in which said amplifier gain network further includes;

a third input impedance forming a junction with said non-inverting input terminal of said amplifier and also forming a junction with said second input impedance;

a fourth input impedance forming a junction with said non-inverting input terminal of said amplifier and also connected to ground potential; and a feedback impedance forming a junction with said output terminal of said amplifier and also forming a junction with said inverting input terminal of said amplifier.

9. The apparatus of claim 3 in which said amplifier gain network includes:

an amplifier having an inverting input terminal and a non-inverting input terminal, and a switching means for selectively connecting said inverting input terminal to ground potential in relation to the sign of said digital value.

10. The apparatus of claim 3 in which said resistance network includes at least one network branch comprised of:

a branch input impedance; and a switch electrically connected in series with said branch input impedance.

11. The apparatus of claim 3 in which said resistance network is comprised of at least one network branch associated with one of said digital magnitude bits, said network branch including:

a branch input impedance;

a switching means forming a junction with said branch input impedance; and a branch ground impedance connected between ground potential and the junction formed by said branch input impedance and said switching means.

12. The apparatus of claim 11 in which said resistance network has a predetermined number of said branches and in which the value of said branch input impedance in a particular branch can be expressed by the relation $$R_n = R_1 2^{(n-1)}$$

where:

$n$ is an integer representing the significance of said digital magnitude bit associated with said branch of said resistance network;

$R_1$ represents the resistance of the branch input impedance of the network branch associated with the most significant digital magnitude bit; and $R_n$ is the resistance of the branch input impedance of the nth network branch.

13. Apparatus for the four quadrant multiplication of an analog value by a digital value comprised of a sign bit and at least one magnitude bit, said apparatus comprising:

an amplifier having a inverting input terminal, a non-inverting input terminal, and an output terminal;

a first input impedance forming a junction with said inverting input terminal of said amplifier;

a second input impedance forming a junction with said first input impedance;

a switching means for selectively connecting the junction of said first and second input impedances to ground potential to cause the gain of the amplifier to be positive or negative;

a third input impedance forming a junction with said non-inverting input terminal of said amplifier and also forming a junction with said second input impedance;

a fourth input impedance forming a junction with said non-inverting input terminal of said amplifier and also connected to ground potential; and a feedback impedance forming a junction with said output terminal of said amplifier and also forming a junction with said inverting input terminal of said amplifier such that said amplifier provides an output in relation to the product of said analog value and the sign of said digital value; and a resistance network responsive to said amplifier network for providing an output in response to the product of the output of said amplifier gain network and the magnitude of said digital value.

14. The apparatus of claim 13 in which the resistance of said third impedance is substantially equal to $(1+\sqrt{5})$ times the resistance of said fourth impedance; and the resistance of said feedback impedance is substantially equal to $(1+\sqrt{5})$ times the resistance of said first impedance.

15. Apparatus for the four quadrant multiplication of an analog value by a digital value comprised of a sign bit and at least one magnitude bit, said apparatus comprising:

an amplifier gain network which provides an output in relation to the product of said analog value and the sign of said digital value;

a predetermined number of branch input impedances with at least one branch input impedance associated with one of said digital magnitude bits and in which the value of a particular branch input impedance can be expressed by the relation $R_1$ equal $R_1$ times 2 with an exponential $(n-1)$ where: $n$ is an integer representing the significance of the digital magnitude bit associated with the branch input impedance, $R_1$ represents the resistance of the branch input impedance associated with the most significant digital magnitude bit, and $R_n$ is the resistance of the branch input impedance of the $n$th network branch;

a branch ground impedance forming a junction with the branch input impedance and connected between ground potential and the junction formed with the branch input impedance; and a switching means connected with the junction formed by the branch input impedance and the branch ground impedance and cooperating with the branch input impedance and branch ground impedance to provide an output in response to the product of the output of the amplifier gain network and the magnitude of the digital value.

16. The apparatus of claim 15 in which said latter resistance network has a predetermined number of said branches and in which the value of said branch ground impedance of a particular branch can be expressed by the relation $$R_{gn} = \frac{2^{(n-1)} \cdot R_1}{2^{(n-1)} - 1}$$

where: $n$ is an integer representing the significance of said digital bit associated with said branch of said resistance network;

$R_1$ represents the resistance of the branch input impedance of the network branch associated with the most significant digital magnitude bit; and $R_{gn}$ is the resistance of the ground impedance of the $n$th network branch.

* * * * *